United States Patent [19]

Waché et al.

[11] 4,151,804

[45] May 1, 1979

[54] ELEVATING APPARATUS PARTICULARLY ADAPTED FOR TELEVISION RECEIVER SUPPORT-TABLES AND THE LIKE

[76] Inventors: Albert Waché, 2 Rue Centrale, Croissy; Eberhard Kunze, 233 Avenue Victor Hugo, Clamart, both of France

[21] Appl. No.: 846,827

[22] Filed: Oct. 31, 1977

[51] Int. Cl.[2] ..... A47B 9/00

[52] U.S. Cl. ..... 108/147; 74/89.15; 312/312

[58] Field of Search ..... 74/89.14, 89.15, 25; 301/93; 108/147; 312/312, 306

[56] References Cited

U.S. PATENT DOCUMENTS

| | | | |
|---|---|---|---|
| 1,088,419 | 2/1914 | Heyer | 108/147 |
| 2,311,972 | 2/1943 | Simpson | 74/89.15 |
| 2,854,308 | 9/1958 | Harris | 312/312 |
| 3,141,102 | 7/1964 | Steingroever | 310/93 |
| 3,404,576 | 10/1968 | Cicognani | 74/231 C |
| 3,447,006 | 5/1969 | Bair | 310/93 |
| 3,761,152 | 9/1978 | Cory | 312/312 |

FOREIGN PATENT DOCUMENTS

| | | | |
|---|---|---|---|
| 1093637 | 1/1954 | France | 108/147 |
| 815918 | 7/1959 | Italy | 312/312 |

*Primary Examiner*—Samuel Scott
*Assistant Examiner*—Gerald A. Anderson
*Attorney, Agent, or Firm*—Rines and Rines, Shapiro and Shapiro

[57] ABSTRACT

This disclosure is concerned with the improvement of motor-driven elevating apparatus for television receiver tables and the like residing in a novel drive transmission embodying notched pulleys and belts for controlling a screw drive, with a braking system actuable only upon the lowering of the table surface or platform.

3 Claims, 2 Drawing Figures

Figure 1:
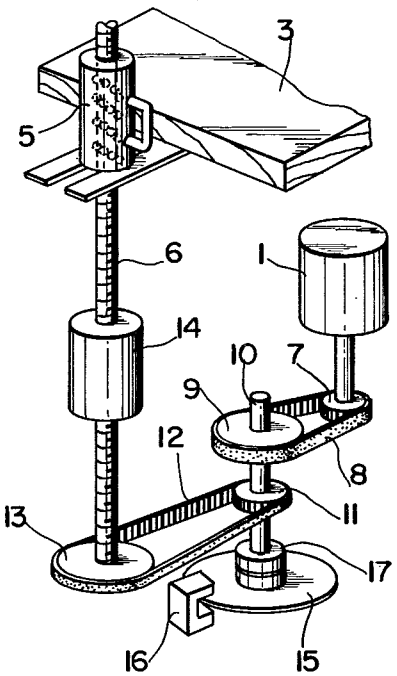

ELEVATING APPARATUS PARTICULARLY ADAPTED FOR TELEVISION RECEIVER SUPPORT-TABLES AND THE LIKE

This present invention relates to an apparatus especially adapted to be applied to a table, the surface of which may be varied in height by the action of a motor, in order to permit an object supported by the table, such as a television receiver or the like, to be elevated to any desired height for its intended exposed use, as well as to enable the table surface to be lowered out of sight to positions where the receiver or the like may be concealed by any known appropriate means such as, among others, a chest or a drapery.

Such apparatus obviously may employ a component, such as the closing lid of such a chest, so that when the lid is closed, it conceals the receiver or the like and the table in its entirety in its lowered position within the chest.

Among prior devices of this nature embodying known techniques, the required elevating and lowering movements are obtained either with the assistance of screws or with the assistance of toothed racks. However the efficacy or output of such transmissions or drives is low, and as a result of the importance at least of the relation of the load and the speed of the lifting or elevating thereof, the latter of which must be suitable for practical use, there results the need to resort to motorized means to develop a motive force of sufficient strength to supply the supplemental energy necessary in view of the afore-said low output.

According to the present invention, in order to obviate the disadvantages mentioned above, the transmission of movement or drive is accomplished, in summary, through the medium of one or several drives or trains formed of notched pulleys and belts activating a screw and cooperating ball-bearing nut. It is known that notched pulley and belt transmissions ensure not only high mechanical efficiency, but also create, upon stoppage, a static resistance torque that is favorable to the locking of the unit into the required position. This inherent static resistance and the possible contribution brought about by the friction of the drive motor brushes on the commutator, obviate the requirement for generally complicated devices such as of the electric brake type, to fix and hold the support table in an elevated position.

An object of the invention, accordingly, is to provide such a novel elevating apparatus (the term elevating also includes the depressing or lowering functions in the reverse direction) particularly adapted for television receivers and the like and, as above explained, eliminating prior art disadvantages.

Other and further objects will be explained hereinafter and are more particularly set forth in the appended claims.

In order to anticipate every possibility of any inopportune acceleration during descending or lowering movement, the apparatus may be provided with slowdown means, in the afore-mentioned direction of movement, such as a Foucault decelerator, paddles immersed in oil, connected to the transmission through the medium of an idler free to move in the descending or lowering direction, or else by means such as a hydraulic damping device in the direction of the descent, mounted directly onto the surface of the table.

Figure 2:
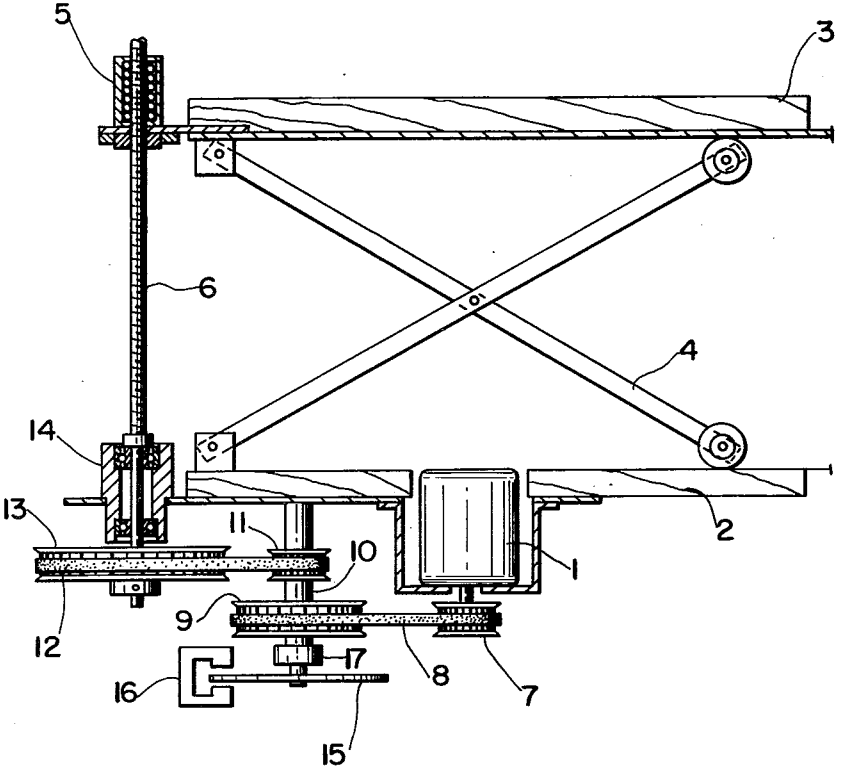

The invention will now be described with reference to the accompanying drawing illustrating a preferred, though not restricted, mode of carrying out the invention, FIG. 1 of which represents a schematic view of a support-table for a television receiver or the like provided with an elevating device in accordance with the invention; and FIG. 2 represents a partial perspective view taken from the left-hand side of FIG. 1.

On these two diagrams the identical reference numerals designate the same elements.

In FIG. 1, an electric motor 1 is attached to the base frame-work 2. A support platform or surface 3 of the table apparatus is supported upon the structure 2, through the medium, in this example, of pivoted cross-bars 4. It is to be understood that other supporting means which would produce the same results could be substituted for the particular members 4.

A ball-bearing nut 5 is integrally mounted along one edge of the table platform or surface 3. This nut is shown movable up and down along the length of a screw 6 in response to rotation of the same. The motor 1 effects such rotation of the screw 6 through the medium of a transmission or drive comprising, in this example, two notched pulley drives: the first comprising the pulley 7, the notched belt 8 and the pulley 9 rigidly attached to a spindle 10; and the second notched pulley drive including a pulley 11, similarly rigidly attached to the spindle 10, a notched belt 12 and a pulley 13.

The pulley 7, coupled to the shaft of the motor 1, through the medium of the belt 8, rotates the pulley 9 rigidly attached to the spindle 10. The pulley 11 is also rigidly attached to the spindle 10 and in turn, through the medium of the belt 12, causes the rotation of the pulley 13 which is connected to rotate the screw 6, bearing within the ball unit 14.

The spindle 10, upon which the pulleys 9 and 11 are mounted, is terminally provided with an electrically conductive metal disc device 15 peripherally rotatable through the gap between two poles of a permanent magnet 16. The disc 15 is itself rotated in the direction controlling the downward motion of the platform 3, being connected to the spindle 10 through the medium of an idler 17 that moves freely in the ascending direction of the platform 3. It will be understood from this that the required elevating, ascending or lifting of the platform 3 is caused by the rotation of the electric motor 1 in one direction, driving the afore-mentioned pulleys and belts, which, in turn, results in the rotation of the screw 6, and causes in this manner the rise of the nut 5 in the corresponding rotating direction. Be reason of the presence of the idler 17, the disc 15 does not move. On the other hand, when the movement of the motor 1 reverses in the opposite direction, this causes the descending or lowering movement of the platform 3. The disc 15 is then carried along in rotation by the locking of the idler 17 in this reverse direction, with the result that the disc 15 rotates between the poles of the electromagnet 16, generating an effective electromagnetic brake that prohibits any bursts of speed or disengagement of the electric motor.

It is to be understood, of course, that the unit which has just been described would, in completed form, employ the usual stops as well as contactors and circuit-breakers for the end of the run. It is also to be understood that, within the scope of the invention it is possible to effect modifications or variations in the number and arrangement of the component elements, such as substituting for the electromagnetic braking device, any equivalent means obtaining the same results, including hydraulic means in particular. The invention is also equally applicable to tables comprising platforms designed to be displaced in ascending or descending directions for other purposes, as well.

What is claimed is:

1. An elevating apparatus particularly adapted for horizontal supporting platforms for television receivers and the like which are movable in height through the action of a motor, so as to elevate the receiver to a desired height for its use, as well as to lower the same to a position where it may be concealed, the improvement characterized by nut means rigidly connected to the supporting platform and receiving vertical screw means for driving the same in order to elevate and lower the supporting platform in response to the direction of rotation of the screw means; means connected with the said motor for rotating the screw means and comprising notched pulley and belt means connecting the motor to the lower end of the screw means; and braking means coupled to said screw means and operable during rotation of the screw means by the notched pulley and belt means in a direction to lower the supporting platform, the braking means comprising idler means operative to activate the braking when the screw means is rotated in the platform lowering direction only.

2. Elevating apparatus as claimed in claim 1, wherein said braking means comprises electrically conductive mean rotatable between the poles of a magnet under the action of said idler means.

3. Elevating apparatus as claimed in claim 1, wherein the nut means comprises a ball-bearing nut.

* * * * *